United States Patent [19]

Hafner et al.

[11] Patent Number: 4,838,156

[45] Date of Patent: Jun. 13, 1989

[54] ROLLER PRESS WITH A DEVICE FOR THE RELIEF OF THE PRESSURE ROLL

[75] Inventors: Paul Hafner; Christian Schiel, both of Heidenheim, Fed. Rep. of Germany

[73] Assignee: J. M. Voith GmbH, Fed. Rep. of Germany

[21] Appl. No.: 186,248

[22] Filed: Apr. 26, 1988

[30] Foreign Application Priority Data

May 9, 1987 [DE] Fed. Rep. of Germany ..... 3715548

[51] Int. Cl.[4] ..... B30B 15/16

[52] U.S. Cl. ..... 100/47; 72/245; 100/50; 100/53; 100/163 A; 100/170; 162/360.1

[58] Field of Search ..... 100/47, 48, 50, 53, 100/155 R, 117, 158 R, 163 A, 159, 160, 161, 162 R, 168–170, 172, 173, 176, 267 R; 72/245, 243; 162/360.1, 271, 361; 137/87, 115, 117

[56] References Cited

U.S. PATENT DOCUMENTS

| | | | |
|---|---|---|---|
| 2,605,108 | 7/1952 | Stephens . | |
| 2,750,986 | 6/1956 | Russell et al. | 100/168 |
| 2,855,829 | 10/1958 | Allemann | 162/255 |
| 2,869,437 | 1/1959 | Hornbostel et al. | 162/360.1 |
| 3,515,637 | 6/1970 | Reynolds et al. | 162/360.1 |
| 3,645,285 | 2/1972 | Miyazaki . | |
| 4,113,079 | 9/1978 | Wright | 100/53 X |
| 4,197,158 | 4/1980 | Johnson | 162/360.1 |
| 4,212,504 | 7/1980 | Krylov et al. | 72/245 X |
| 4,597,326 | 7/1986 | Tapani | 100/47 X |
| 4,620,477 | 11/1986 | Ripani et al. | 100/170 X |
| 4,632,325 | 12/1986 | Feyerl et al. . | |
| 4,770,094 | 9/1988 | Schiel | 100/47 |

FOREIGN PATENT DOCUMENTS

| | | |
|---|---|---|
| 1425658 | 7/1969 | Fed. Rep. of Germany . |
| 3314837A1 | 12/1983 | Fed. Rep. of Germany . |
| 940942 | 6/1963 | United Kingdom . |
| 1071265 | 7/1967 | United Kingdom . |
| 1385068 | 2/1975 | United Kingdom . |

*Primary Examiner*—Timothy F. Simone

*Attorney, Agent, or Firm*—Ostrolenk, Faber, Gerb & Soffen

[57] ABSTRACT

A roller press has a press roll and at least one pressure roll applying pressure to it. In the end region of each pressure roll, there is an associated positioning cylinder. The positioning cylinders relieve the pressure of the pressure roll against the press roll automatically upon an impermissible increase in the operating pressure in the positioning cylinder. For this purpose, each positioning cylinder has a safety valve which is operated either by the working fluid in the positioning cylinder to the pressure relief condition or by an electrical signal, in different embodiments, to relieve pressure in the positioning cylinder. The safety valves are coupled to each other by a signal line. When one safety valve relieves one positioning cylinder, all of the positioning cylinders are relieved. Details of the working fluid operated safety valves and of the electrically operated safety valves are disclosed, including details of the valve body and the application of pressures upon the valve bodies which causes them to shift.

15 Claims, 4 Drawing Sheets

ROLLER PRESS WITH A DEVICE FOR THE RELIEF OF THE PRESSURE ROLL

BACKGROUND OF THE INVENTION

The present invention refers to a roller press comprising a press roll and one or two cooperating pressure rolls, with particular application to a paper machine press section.

A roller press of this type is taught in Federal Republic of Germany Patent No. 959,702, corresponding to U.S. Pat. No. 2,855,829. It is there combined with a press section in a machine for the manufacture of paper and cellulose webs. In general, a roller press of this type can be used in wet presses and calenders and paper-making machines, as well as in plastic calenders and rolling mills.

In a known roller press or plant for the production of paper and cellulose webs, there is a pressure roll which is intended to be pressed against a fixed suction roll and there is a device for automatically lifting the pressure roll off the suction roll. Such lift occurs when the pressure prevailing in the suction line of the suction roll exceeds a given working pressure during the operation of the roller press, i.e. the required vacuum is no longer present in the suction line. The pressure roll is connected with a pressure cylinder which is finally activated when drying of the web of paper is no longer assured.

Brief variations in pressure are not recognized or responded to in the known design. In particular, disturbances on the suction roll which are limited in space are not recognized since measurements of the amount of air in the suction lines are too inaccurate for recognizing such deviations. For instance, entrained foreign bodies or folded regions of a pulp drainage felt, which are traveling through the press nip between the suction roll and the pressure roll, go unrecognized. For dependable operation of such a roller press and for the protection of the expensive roll coverings and pulp drainage felts, it is important that even brief, minor disturbances be rapidly and dependably recognized.

SUMMARY OF THE INVENTION

The object of the present invention is to provide a roller press in which even relatively small disturbances are recognized, preferably rapidly. Another object is that as a result of these recognized disturbances, the press nip is immediately relieved of load over its entire width and, if necessary, the nip may also be opened.

The roller press of the present invention is shown in two embodiments, one that works hydraulically with working fluid and the other that is electrically operated. In all embodiments, the roller press includes a press roll. Means fix the press roll in position, but enable it to rotate. At least one pressure roll is arranged parallel to the press roll. The press and pressure rolls have respective surfaces that press against each other.

A plurality of positioning cylinders is associated with each of the pressure rolls for displacing the pressure roll with respect to the press roll so that the surfaces press together or move apart in a direction transverse to the axis of the pressure roll. There are operating means connected with each of the positioning cylinders for operating the cylinders to separate the pressure roll from the press roll as a result of a disturbance in the pressure at any of the positioning cylinders. That disturbance would occur upon some anomaly in the press nip.

That operating means comprises a respective safety valve connected with each positioning cylinder. The safety valve is operated by the respective positioning cylinder to a valve open condition for relieving pressure in the positioning cylinder upon the disturbance in the press nip. Connecting means functionally connect all of the safety valves with each other. Upon an increase in the pressure in one positioning cylinder, which causes the opening of its respective safety valve, all of the safety valves correspondingly move to the open condition so that all the pressure cylinders are relieved.

In one preferred embodiment, there are two of the pressure rolls. Each of the pressure rolls has a respective plurality of the positioning cylinders, each provided with a respective safety valve. All of the safety valves for all of the pressure rolls are connected together for relieving pressure if the pressure increases in any of the positioning cylinders.

In one embodiment, the safety valves have a fluid connection to the respective positioning cylinder and are operated by over-pressure in the positioning cylinder. In another embodiment, all the safety valves are electrically operable. Over-pressure in any positioning cylinder operates the valve electrically to the valve open pressure relief condition. All of the safety valves are here electrically connected to each other to operate together.

There is a main control valve connected with a source of working fluid which pumps the positioning cylinders to operate and that valve is also connected with the positioning cylinders of each respective pressure roll and with the respective safety valves of the respective pressure rolls. Closing of the main control valve from the source of working fluid prevents the passage of working fluid to the positioning cylinders and thereby triggers the closing of the safety valves to the non-relief conditions. There are closing means in the safety valves for closing the safety valves, upon the closing of the main control valve against flow of working fluid from the main control valve to the safety valves.

Where the pressure roll is above the press roll, the pressure roll rests with its own weight upon the press roll. The safety valve is connected with the respective positioning cylinders for causing the positioning cylinders to raise the pressure roll off the press roll.

The safety valve comprises a valve housing having a cylindrical chamber in it in which the valve body is movable. The valve body has opposite first and second active surfaces and there is a first pressure space above the first surface and the second pressure space below the second surface. The first pressure space is connected with the positioning cylinder to be acted upon directly by the pressure in the positioning cylinder. The second pressure space communicates with the positioning cylinder through a throttle. A spring acts upon the valve body for moving the valve body in the same direction as the pressure applied to the second surface of the valve body.

The connecting means between the various safety valves comprises a signal line connected to the second pressure space of every safety valve for connecting the second pressure spaces, whereby relief of the second pressure space of one valve relieves the second pressure space of all of them. An outlet relief connects to any one of the second pressure spaces, whereby relief of one pressure space relieves all. The valve bodies are arranged so that an increase in the pressure in one of the positioning cylinders moves the respective valve body for that cylinder to the position for relieving the pressure in the respective second pressure space and through the signal line connects all of the second pressure spaces for relieving them. The valve bodies are further designed so that upon shifting of the valve bodies upon relief of the second pressure spaces, the valve bodies have a further connection to the respective first pressure spaces.

The return spring has a force adjusted so that at a predetermined pressure in the positioning cylinder, the first and second active surfaces are in equilibrium with the respective safety valve in the valve closed, non-relieving position. The ratio of the first and second active surfaces is in the range of about 1.02 to 1.2 for the first active surface to 1 for the second active surface.

The first pressure space in the safety valve has a first outlet while the second pressure space has a second outlet. These outlets are arranged and dimensioned relative to each other and to the valve body that after relief of the working pressure in the second pressure space, the first outlet from the first pressure space is opened to an extent that the pressure acting on the first pressure surface is equal to the force being exerted by the return spring.

The valve housing of the safety valve contains a valve body that is actually comprised of two closed cylinders, with each of the cylinders having one of the active pressure surfaces defined on it. A first inlet into the valve housing communicates into the first pressure space while the second valve inlet into the valve housing communicates into the second pressure space. The throttle comprises a throttle line between the first and second inlet bores. The housing also has outlet bores from the first pressure space and from the second pressure space for communicating to the outlet relief. In particular, the first cylinder comprises a hollow shell and the second cylinder also comprises a hollow shell and the communications from the first and second cylinders to the respective outlets is through openings through the respective hollow shells.

In the alternate electrical embodiment, each of the safety valves comprises an electromagnetically actuated valve which is normally closed in a first operating position and which communicates with the positioning cylinder and also with a relief for pressure. The safety valve has one operating position in which it is closed against relieving pressure from the positioning cylinder to the outlet relief. The safety valve has a second position which connects the positioning cylinder to the outlet relief for relieving pressure in the positioning cylinder. A pressure switch electrically connects the safety valve and is operatively connected with the positioning cylinder. Upon an increase of pressure in the positioning cylinder, the pressure switch is operated for operating the safety valve to switch between the first closed position and the second pressure relief position.

An electric relay electrically connects all of the safety valves and is switched to operate by the signal which switches any of the safety valves from their first to their second positions. The relay includes a switch for being reset for enabling the connected safety valves to be reset into their first positions.

Other objects and features of the present invention will become apparent from the following description of the preferred embodiments of the invention considered in conjunction with the accompanying drawings.

DESCRIPTION OF THE PREFERRED EMBODIMENTS

Figure 1:
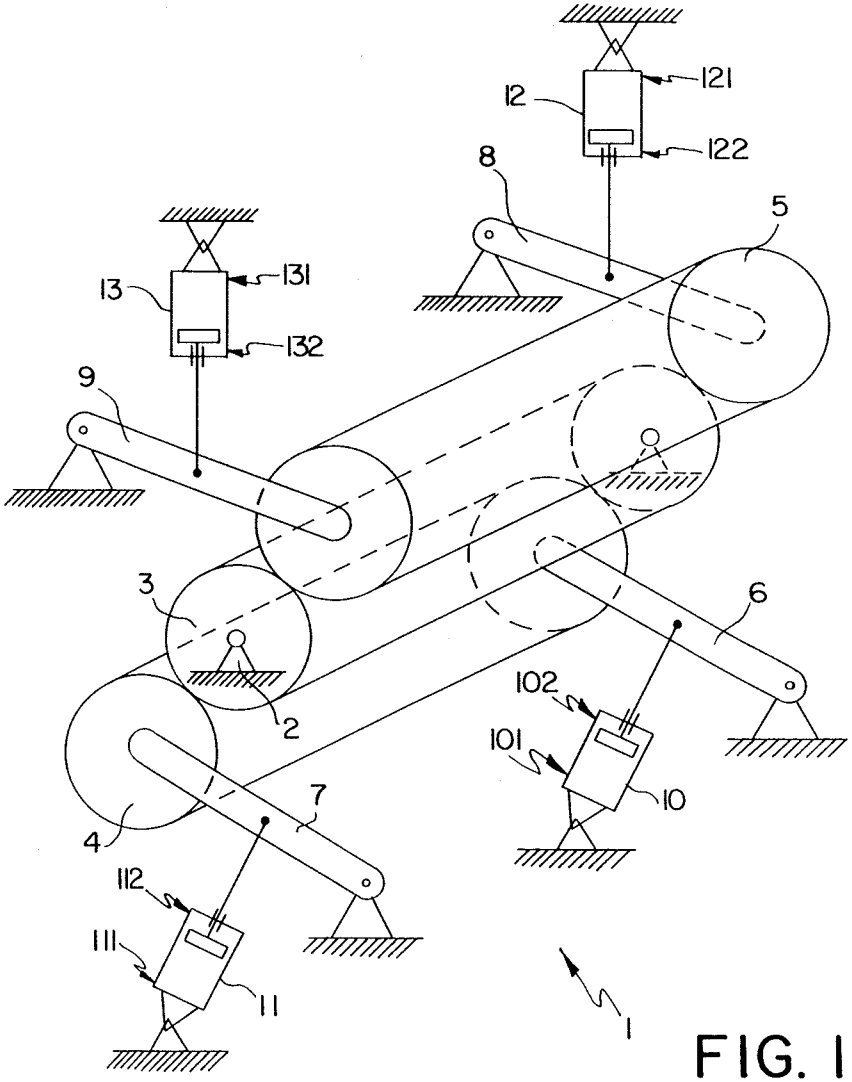
FIG. 1 diagrammatically shows a three-roll wet press.

FIG. 1 shows a so-called three-roll wet press, for example, that shown in Federal Republic of Germany Patent No. 1,090,076, corresponding to U.S. Pat. No. 2,869,437. For reasons of clarity of the drawing, the drainage felts, the paper web to be dried as well as guide rolls, frame elements and other mechanical structural parts of the press are not shown.

The three-roll wet press 1 comprises a press roll 3, which is mounted in a fixed position in stationary supports 2, and two pressure rolls 4, 5 which can be applied tangentially against the press. The longitudinal axes of the press roll 3 and the pressure rolls 4, 5 lie in the same plane, and the pressure rolls lie on opposite sides of the pressure roll.

One pressure roll 4, the lower one in FIG. 1, is applied against the press roll 3 from below, in opposition to its weight, by a first pair of levers 6, 7. A second pressure roll 5 is applied against the press roll 3, aided by its own weight, from above by a second pair of levers 8, 9. Each of the levers 6, 7, 8 and 9 is pivotally mounted in a fixed support at one end of the lever and is turnably connected at the other end of the lever to the respective ends of the pressure rolls 4, 5.

Respective positioning cylinders 10, 11, 12 and 13 actuate or move the individual levers 6, 7, 8 and 9. The pressure rolls 4, 5 are thereby pressed with the necessary pressing force against the press roll 3. The pressing force between the pressure rolls 4, 5 and the press roll 3 is determined by the working pressure in the respective positioning cylinders 10, 11, 12, 13.

Figure 2:
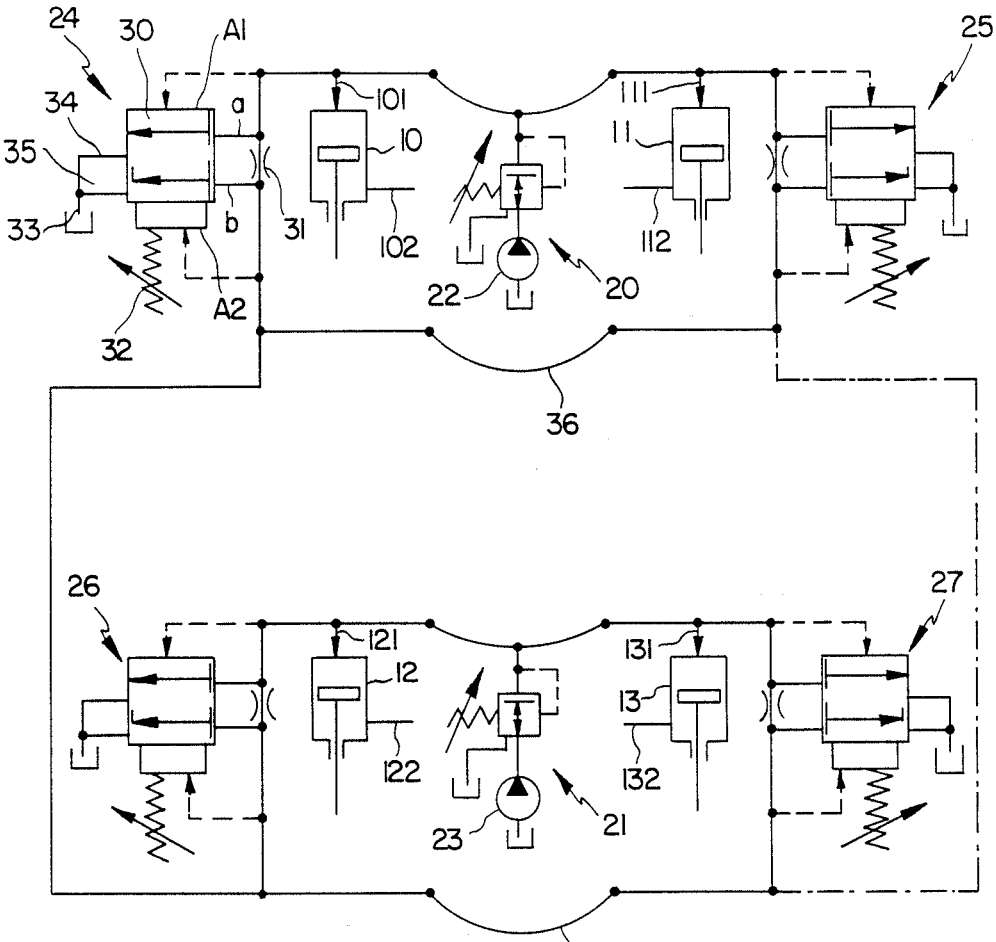
FIG. 2 diagrammatically shows the hydraulic circuit for the three-roll wet press of FIG. 1.

Referring to FIG. 2, each of the positioning cylinders 10, 11, 12, 13 has a respective pair of inlets 101, 102; 111, 112; 121, 122; 131, 132 for the working fluid, e.g. oil, which acts upon the piston top and the piston rod sides, respectively, of the respective operating or lift pistons. Fluid applied at the inlets brings the working pistons into the correct working position or to the correct pressing pressure. In the three-roll wet press 1 shown in FIG. 1 as well as in the two-roll press to be described with reference to FIG. 5, each pressure roll has a positioning cylinder associated with each of its ends so that the pressing force, i.e. the working pressure, between press roll and pressure rolls can be precisely adjusted over the entire width of the roll section (length of the pressure roll).

The invention comprises associating a safety valve with each of the positioning cylinders through which an increase in pressure which is sensed in a positioning cylinder and which is due, for instance, to a disturbance in the press nip between one of the pressure rolls and the press roll, causes relief of the working pressure of this positioning cylinder and also of the other positioning cylinders.

Each positioning cylinder 10, 11, 12, 13 is associated with a respective lever 6, 7, 8, 9, which acts on the ends of the pressure rolls in such a manner that the positioning cylinders 10, 11 correspond to the one pressure roll and the positioning cylinders 12, 13 to the other pressure roll.

FIG. 2 diagrams the hydraulic system of the three-roll wet press. The positioning cylinders 10, 11 are paired and 12, 13 are paired with each other. The paired cylinders have inlets 101, 111 and 121, 131, respectively, connected in each case jointly to a main control valve 20 and 21, respectively. Via the main control valves 20, 21, the positioning cylinders 10, 11 and 12, 13 can be connected to oil pumps 22 and 23, respectively, which provide the positioning cylinders 10, 11 and 12, 13, respectively, with the required working pressure via their inlets 101, 111 and 121, 131, respectively.

Each positioning cylinder 10, 11, 12, 13 has associated with it a respective safety valve 24, 25, 26, 27, which is designed so that upon an increase in pressure in the corresponding positioning cylinder 10, 11, 12, 13, i.e. upon the occurrence of excess pressure, the respective safety valve immediately relieves the pressure in its positioning cylinders 10, 11, 12, 13. The safety valves 24, 25, 26, 27 of one press section are coupled so that an excess pressure in the corresponding positioning cylinder 10, 11, 12, 13, which is sensed in one of the safety valves 24, 25, 26, 27, is simultaneously conducted to all the other safety valves 24, 25, 26, 27 of the same press section. The other safety valves then also relieve the working pressure of the corresponding positioning cylinders 10, 11, 12, 13. Excess pressure in one positioning cylinder 10, 11, 12, 13, due, for instance, to a disturbance in the neighboring press nip, thus relieves all of the positioning cylinders of load. Referring to FIG. 1, this means that the lower pressure roller 4 moves downward under its own weight and opens the press nip. If the upper pressure roll 5 is also to be lifted off the press roll, i.e. the upper press nip is to be opened, the corresponding positioning cylinders 12, 13 must be acted upon on the piston rod side. In addition, still other functions, such as, for instance, the stopping of the press drive, can be initiated by a work signal which is generated in one of the safety vales 10, 11, 12, 13 as a result of a condition of excess pressure.

The manner of operation and the structural development of a safety valve 24, 25, 25, 27 is now discussed. The safety valve 24 is typical of valves 25, 26, 27. Valve 24 has two line connections a, b on its inlet side. It also has an axially movable valve body 30 schematically shown as vertically movable in FIG. 2. On its outlet side, there are two connections 34, 35. These are both connected to a relief line 33 which extends to an oil collecting pan. The movable valve body 30 has a first, larger end surface A1 and a second, opposite, somewhat smaller end surface A2. The first end surface A1 and the connection a are connected to the inlet 101 of the cylinder 10 and are therefore directly acted upon by the working pressure in that cylinder. The second, smaller end surface A2 and the connection b are also connected to the inlet 101 of the cylinder 10, but via a throttle 31. The dashed arrow line from line 36 to surface A2 shows how surface A2 is acted upon. The second end surface A2 is, in addition, acted on by the force of a spring 32. In the static condition, i.e. as long as no working fluid or oil flows through the throttle, the pressure on the surfaces A1 and A2 is the same.

In FIG. 2, the valve bodies 30 of the safety valves 24, 25, 26, 27 are shown against the upper stop. Thus, the communications to the relief line 33 are interrupted, i.e. closed. To couple the safety valves 24, 25, 26, 27 of a press section to each other, the second end surfaces A2 of all safety valves 24, 25, 26, 27 are connected to each other via signal lines 36. In the event of an impermissible increase in the working pressure in one of the positioning cylinders, for example cylinder 10, the increased pressure on the end surface A1 of the safety valve 24 displaces the valve body 30 in the "open" direction toward the bottom in FIG. 2. This relieves the pressure present at the smaller end surface A2 of the valve body of the safety valve 24 by connecting the two connections b and 35. The signal line 36 at the valve 24 is relieved also through such connections. At the same time, the smaller end surfaces A2 of the other safety valves 25, 26 and 27 are also relieved via the connected signal lines 36, so that the valve bodies of the other valves also shift down and the other valves are also open. As a result, the respective inlets 101, 111, 121, 131 of all of the valves are connected to the relief lines 33 on all positioning cylinders 10, 11, 12 and 13.

The switchable connections between the pressure-side connections a, b and the outlet-side connections 34, 35 are indicated by the solid arrows in the valve body 30. Due to excess pressure or because of the difference in pressure on the first end surface A1 and the second end surface A2, if the valve body 30 is displaced against the force of the spring 32, out of the equilibrium position and toward the bottom in the drawing, then the first passage b-35 corresponding to the lower arrow is opened first, which permits the pressure on the second end surface A2 to drop toward zero. The valve body 30 is then pushed down further and with increased force so that the second passage a-34 corresponding to the upper arrow also opens, while the first passage b-35 remains open.

The force of the spring 32 is so adjusted that, slightly below the threshold or difference value which triggers the start of the switching process of a safety valve 24, 25, 26, 27, the setting forces acting on the two end surfaces A1 and A2 are in equilibrium with each other. The force of the spring 32 corresponds in this case to the product of the difference in area of the end surfaces A1 and A2 times the working pressure. With this adjustment of the force of the spring 32, the valve body 30 of each of the safety valves 24, 25, 26, 27 "floats" in an intermediate position, which is still closed. The valve body thus has a very short reaction time, i.e. switching time. In order to be able to use small spring forces, the ratio between the two end surfaces (effective surfaces) A1 and A2 is only slightly greater than 1, and preferably between 1.02 and 1.2 for the surface A1 to 1 for the surface A2.

Once any safety valve 24, 25, 26, 27 has opened, the communication between the connection a of the working pressure and the relief line 33 remains open only to such an extent that the residual force acting on the first end surface A1 corresponds to the force of the spring 32. By this structural solution, the connection of the signal line 36 to the relief line 33 is finally held open. Thus, there is no possibility that the working pressure at the positioning cylinders 10, 11, 12, 13 will unintentionally build up again. This is necessary to assure that the working pressure does not build up before the cause of the increase in pressure has been recognized and eliminated.

In order to reach the normal working condition again, i.e. have working pressure available at all positioning cylinders 10, 11, 12, 13, the main control valves 20 and 21 must first be brought into their zero positions. In this way, the pressure acting on the first end surface A1 is brought to zero and the valve bodies 30 of the safety valves 24, 25, 26, 27 are pushed by the force of their springs 32 into the closed position until the valve bodies 30 again lie against their upper end stops. The main control valves 20, 21 can now be opened, i.e. the positioning cylinders 10, 11, 12, 13 can again be acted upon by working pressure.

The through switched condition of the safety valve 24, 25, 26, 27 will be described with reference to FIG. 3. In this switching condition, both the inlet a on the working pressure side and the second inlet b coupled via the throttle line 31 are in communication with the relief line 33. The connection of the inlet b to the relief line 33 is entirely open. Between the working pressure line a and the relief line 33, there is a throttled connection, since the force of the spring 32 maintains the equilibrium. This means that the pressure liquid conveyed by the oil pump 22 or 23 flows in part over the working pressure side connection a and in part over the throttled connection b to the relief line 33.

Figure 4:
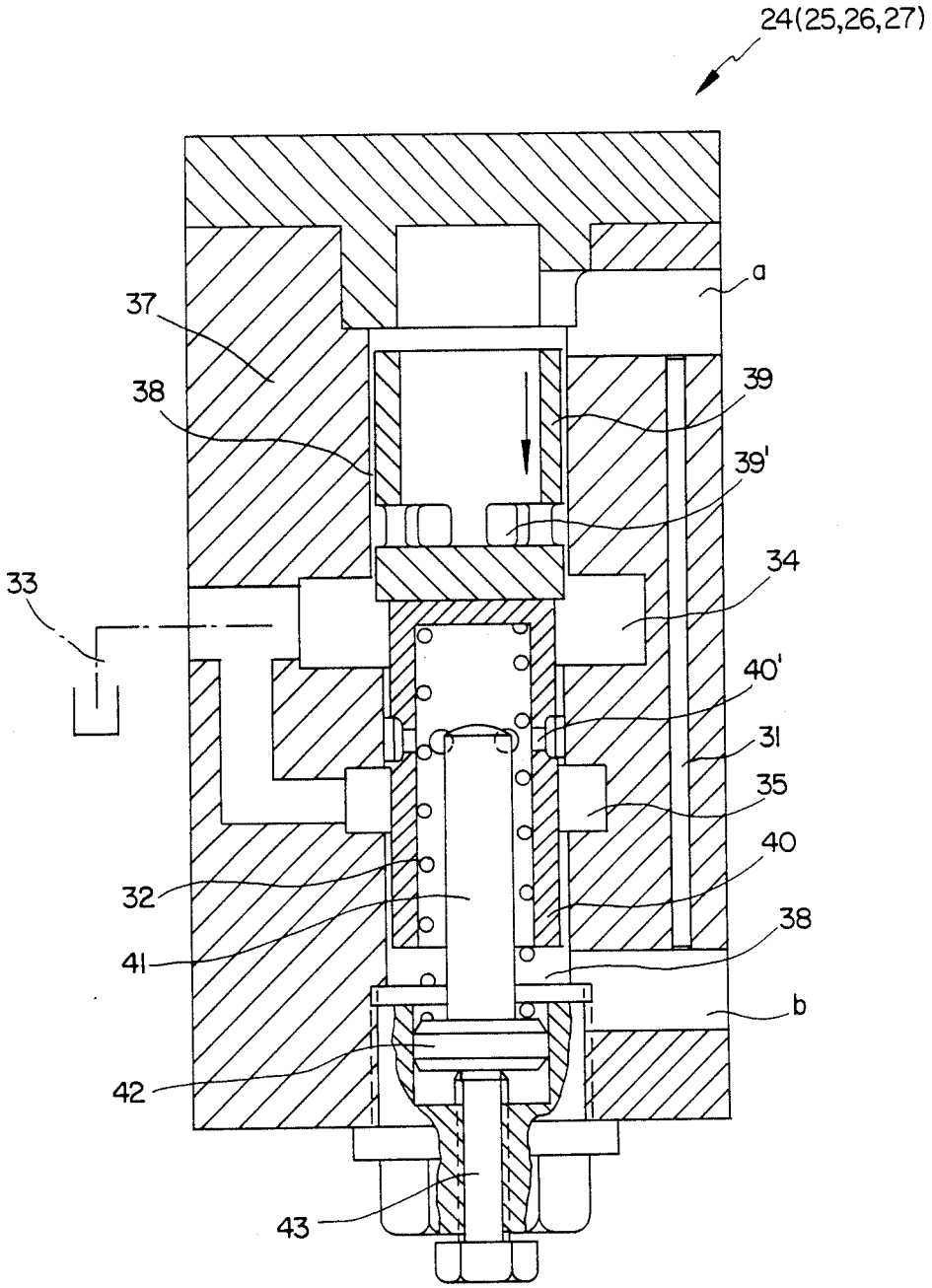
FIG. 4 is a cross-section showing the structural development of one of the safety valves shown in FIG. 2.

The structure of a safety valve 24, 25, 26, 27 is explained with reference to FIG. 4, which is a longitudinal section through the valve. The safety valve includes a valve block 37 within which the valve body is contained for axial movement within a central bore 38. In FIG. 4, the valve body 30 is in so called "floating" equilibrium, which it assumes when the working pressure is slightly below the predetermined trigger or limit value set. This limit value is preferably selected so that the difference between the pressure at which the valve body lifts off the upper end stop and at which the pressure relief commences is, for instance, 5% of the maximum permissible pressing pressure between pressure roll and press roll.

Figure 3:
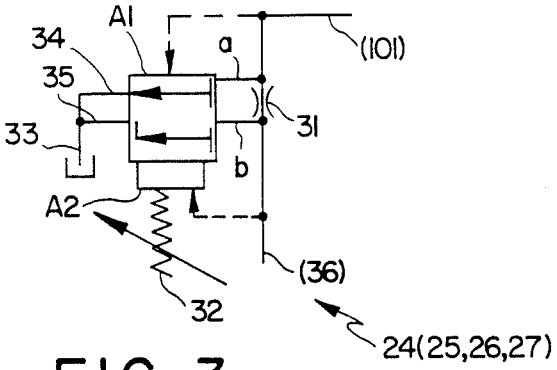
FIG. 3 diagrammatically shows one of the safety valves shown in FIG. 2, in its second switch position.

The valve body 30 is actually comprised of two cylinders 39, 40, each of which is closed at one side so that they together define two closed end surfaces, which correspond to the active surfaces A1 and A2, respectively, of the safety valves 24, 25, 26, 27 in accordance with FIGS. 2 and 3, resting against each other. The "upper" cylinder 39 has a larger diameter A1. There is access from the open side of the upper cylinder 39 to the working pressure line a. The "lower" cylinder 40 has a smaller diameter A2. There is access from the open side of the lower cylinder 40 to the inlet b which is connected via the throttle line 31 to the working pressure line a.

In another embodiment (not shown), the two cylinders 39, 40 can also be combined into a single piece valve body 30. Instead of the throttle line 31 arranged in the housing 37, a coaxial throttle bore can then be provided in the valve body 30.

The lower cylinder 40 is resiliently mounted via a spring 32. The force of the spring 32 is adjustable from the outside by a bolt 41 which is axially displaceable coaxial to the central bore 38. The bolt 41 has a support disk 42 which corresponds to the diameter of the spring 32 and which can be displaced axially via a bolt 43 to adjust the spring 32 to the predetermined spring force.

Both cylinders 39, 40 have respective openings 39', 40' distributed over their peripheries. Paths to the relief line 33 can be opened through the openings 39', 40'. For forming these paths, two annular spaces 34, 35 are worked into the valve block 37 for the connections. Both of the spaces 34, 35 have a connection to the relief line 33, as shown in FIGS. 2 and 3. The arrangement of the annular spaces 34, 35 and their association with the openings 39', 40' is such that, upon an axial movement in the direction of arrow X of the valve bodies 30, i.e. of the two cylinders 39, 40, first the openings 40' of the cylinder 40 having the smaller effective-surface/end-surface A2 are connected to the lower annular space 35. Upon further displacement of the valve bodies 30, the connecting line between the working pressure line a and the relief line 33 then also opens via the openings 39' while the connection of openings 40' at space 35 remains.

The interaction with respect to the spring force and the consequence of the opening of the line paths a and b to the low pressure line 33 has already been explained with reference to FIGS. 2 and 3.

A second embodiment of the invention is explained below with reference to a two-roll press shown in FIG. 5. In contrast to the embodiments of FIGS. 2, 3 and 4, FIG. 5 concerns an electrical system. It has the advantage from the start that the propagation of the signal is very much faster, which can be important with respect to rolls having a width of up to ten meters.

For each pressure roll, there are two positioning cylinders 10, 11, each having a respective associated electromagnetic safety valve 50, 51. To transmit a signal in the event that the working pressure in one of the positioning cylinders 10, 11 increases to an impermissible extent, a respective electric pressure sensing switch 52, 53 is arranged on each positioning cylinder 10, 11.

If one of the pressure switches 52, 53 closes as a result of an impermissibly high pressure in its respective positioning cylinder 10, 11, then the electromagnets of all safety valves 50, 51 are energized via the corresponding switch signal as a work signal when those valves are coupled with respect to the signal. At the same time, the safety valves 50, 51 are are thereby brought into an operating position which switches open a connection to a low-pressure connection, for instance of an oil collection pan.

Figure 5:
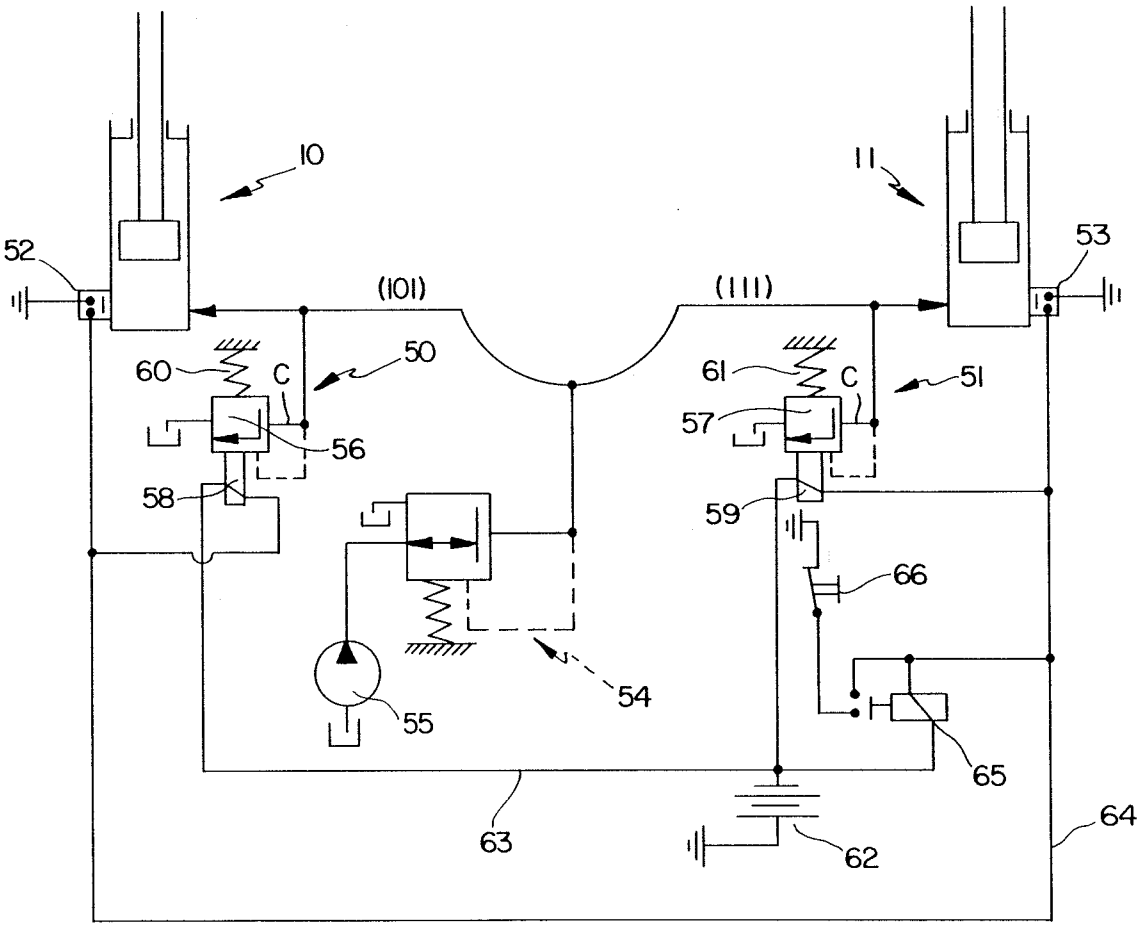
FIG. 5 diagrammatically shows a second embodiment of the hydraulic circuit for a two-roll press.

Referring to FIG. 5, each safety valve 50, 51 has an inlet connection c. These connections c are connected to the working pressure side connection of the positioning cylinders 10 and 11, respectively, and, via a main control valve 54, to an oil pump 55. The safety valves 50, 51 comprise respective valve bodies 56 and 57, which are held by the force of respective setting springs 60, 61 in a first closed pathway operating position. In this first operating position shown in the drawing, the connection to be switched by each valve body is closed.

The electromagnets 58, 59 may be supplied with electricity via electric line 63 from a voltage source 62. The electromagnets 58, 59 are connected via a signal line 64 to each other and to the pressure switches 52, 53. If either pressure switch 52, 53 is closed due to elevated pressure, then the electromagnets 58, 59 are energized. The valve bodies 56, 57 are then pushed (up in FIG. 5) into their second open pathway operating position against the setting springs 60, 61. As a result, the inlet connection a from the cylinders 10, 11 is connected to the lowpressure line. The working pressure at both positioning cylinders 10, 11 together thus drops to zero. Of course, the switching movement can also be reversed such that the electromagnets are energized in order to close the valves while they are cut off from current to open the valves when there is an overload signal.

As already explained based upon FIG. 2, the working pressure must be prevented from again building up prematurely in an undesired manner. For this purpose, a holding circuit is integrated in the circuit, to assure that the safety valves 50, 51 remain in the open condition, which is their second operating position. This holding circuit comprises a relay 65 which is in parallel with the circuit of the electromagnets 58, 59 of the safety valves 50, 51 and can be so acted upon via a switch 66 which can be switched to ground potential that the electromagnets 58, 59 are energized and the valve bodies 56, 57 are pulled against the force of the setting springs 60, 61 into the first or closing operating position. Now working pressure can again be built up at the positioning cylinders 10, 11 via the main control valve 54.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A roller press comprising:

a press roll;

means for fixing the press roll in position;

at least one pressure roll, arranged parallel to the press roll; the press and pressure rolls having respective surfaces for being pressed against one another; a plurality of positioning cylinders connected to each pressure roll for displacing the pressure roll with respect to the press roll, for separating the surface of the pressure roll off the surface of the press roll in a direction transversely to the longitudinal axis of the pressure roll;

operating means connected with each of the positioning cylinders; the operating means comprising a respective safety valve connected with each of the positioning cylinder for being operated by the respective positioning cylinder to an open condition of the safety valve for relieving the pressure in the positioning cylinder and for operating the cylinder to separate the pressure roll from the press roll upon a disturbance in the press nip between the press roll and the pressure roll which momentarily increases the pressure in any of the positioning cylinders; and connecting means functionally connecting all of the safety valves with each other such that upon an increase in pressure in one positioning cylinder, which causes the opening of the respective safety valve, all of the safety valves are correspondingly moved to the open condition so that all of the pressure cylinders are relieved.

2. The roller press of claim 1, comprising two of the pressure rolls, each arranged parallel to the press roll and each having a respective pressing surface engaging the surface of the press roll; each of the pressure rolls having a respective plurality of the positioning cylinders, each positioning cylinder being provided with a respective safety valve; all of the safety valves being functionally connected by the connecting means, such that upon an increase in pressure occurring in one of the positioning cylinders, the respective safety valve opening to relieve the pressure in the positioning cylinder, and the connection between the safety valves causing all of the other safety valves of all of the pressure rolls to open for relieving all of the positioning cylinders.

3. The roller press of claim 1, wherein each of the safety valves has a fluid connection to the respective positioning cylinder, and the means connecting all of the safety valves comprise a working fluid connection between all of the safety valves.

4. The roller press of claim 1, wherein each of the safety valves is electrically operable; an electrical power source is connected with each of the safety valves for operating them to a first, valve closed, nonrelief position; upon an increase of pressure in one of the positioning cylinders, the respective safety valve is electrically operated to the valve open position for relieving the pressure in the respective positioning cylinder; and the connecting means electrically connect the safety valves such that upon movement of one of the safety valves to the valve open, relief condition, the other safety valves are moved to the valve open, relief condition.

5. The roller press of claim 1, further comprising a main control valve connected with a source of working fluid and with the positioning cylinders of each respective pressure roll and with the respective safety valves of the respective pressure roll such that closing of the main control valve from the source of working fluid for preventing passage of working fluid to the respective positioning cylinders triggers the closing of the respective safety valves to the nonrelief condition, and closing means in the safety valves for closing the safety valves upon the closing of the main control valve against flow of working fluid from the main control valve to the safety valves.

6. The roller press of claim 1, wherein the pressure roll rests with its own weight upon the press roll, and the safety valve being connected with the respective positioning cylinders for causing the positioning cylinder to raise the pressure roll off the press roll upon the occurrence of an increase in pressure in one positioning cylinder which is sensed by the respective safety valve of that positioning cylinder.

7. The roller press of claim 1, wherein the safety valve comprises a movable valve body and a chamber containing the valve body and in which the valve body is movable; the valve body having a first active surface; the chamber including a first pressure space above the first active surface, the first surface being connected with the positioning cylinder for being acted upon directly by the pressure in the positioning cylinder; the valve body having an opposite second active surface of smaller surface area than the first active surface; the chamber including a second pressure space above the second active surface; and a spring for acting upon the valve body for moving the valve body in the same direction as pressure applied to the second surface of the valve body;

the second pressure space being also connected to the working pressure of the positioning cylinder and a throttle for that connection being disposed between the positioning cylinder and the second pressure space;

the connecting means comprising a signal line connected to the second pressure space of every safety valve for connecting the second pressure spaces of all of the safety valves to each other, whereby relief of the second pressure space of one of the safety valves relieves the second pressure space of all of the safety valves;

an outlet relief connectable to any of the second pressure spaces; the valve bodies being arranged such that an increase in the pressure in one of the positioning cylinders moves the respective valve body for that cylinder to the position for relieving the pressure in the respective second pressure space and, through the signal line connecting all of the second pressure spaces, for relieving all of the second pressure spaces, and the valve bodies being further comprised such that upon shifting of the valve bodies upon relief of the second pressure spaces, the valve bodies having a further connection to the respective first pressure spaces.

8. The roller press of claim 7, wherein the spring has a force adjusted so that at a predetermined pressure in the positioning cylinder, the first and the second active surfaces are in equilibrium with the respective safety valve in the valve closed, non-relieving position.

9. The roller press of claim 8, wherein the ratio of the first and the second active surfaces is in the range of about 1.02 to 1.2 for the first active surface to 1 for the second active surface

10. The roller press of claim 8, wherein the first pressure space for the safety valve has a first outlet and the second pressure space for the safety valve has a second outlet, the first and second outlets being so arranged and dimensioned relative to each other and to the valve body of the safety valve that after relief of the working pressure in the second pressure space, the first outlet from the first pressure space is opened to an extent that the pressure acting on the first pressure surface is equal to the force being exerted by the spring.

11. The roller press of claim 8, wherein the safety valve comprises a valve housing having a bore through it and the movable valve body in the bore comprises two cylinders movable through the bore, the cylinders being closed, such that one closed cylinder in the bore defines the first pressure space and the other closed cylinder in the bore defines the second pressure space, and the first and second cylinders are movable together axially in the bore; the spring engaging the cylinders in the bore;

a first inlet into the valve housing for communicating into the first pressure space; a second inlet into the valve housing for communicating into the second pressure space; the throttle comprising a throttle line between the first and second inlet bores, and the first inlet bore being directly connected with the respective pressure cylinder while the second bore is connected with the pressure cylinder through the throttle and the second bore is also connected to the signal line;

a first outlet bore positioned for communicating with the first pressure space for leading to the outlet relief, and a second outlet bore in the valve housing for communicating with the second pressure space and connecting the second pressure space to the outlet relief.

12. The roller press of claim 11, wherein the valve body includes a respective first annular space in the valve body connectable with the relief, the first annular space being placed so that upon axial movement of the first valve body cylinder under the influence of pressure from the positioning cylinder following relief of the second pressure space, the first pressure space communicates to the first annular space;

a second annular space in the valve housing and connected with the relief and so positioned in the valve housing that upon movement of the second cylinder following relief of the second pressure space, the second cylinder moves to communicate the second pressure space into the second annular space for relief of the second pressure space through the relief.

13. The roller press of claim 12, wherein the first cylinder comprises a first hollow shell closed on the side toward the second cylinder and opened on the other side for defining the first pressure space and above the first shell; the second cylinder comprises a second hollow shell, closed on the side toward the first cylinder and opened on the other side for defining the second pressure space in and above the second shell; the communication from the first cylinder to the first annular space is through the first shell defining the first pressure space, and the communication from the second pressure cylinder to the second annular space is through the second shell defining the second pressure space.

14. The roller press of claim 4, wherein each of the safety valves comprises an electromagnetically actuated valve which is normally closed in a first operating position and which communicates with the positioning cylinder and also with a relief for pressure, the safety valve having one operating position in which it is closed against relieving pressure from the positioning cylinder to the outlet relief; the safety valve having a second operating position which connects the positioning cylinder to the outlet relief for relieving the pressure in the positioning cylinder;

a pressure switch electrically connected with the safety valve and being operatively connected with the positioning cylinder such that upon an increase of pressure in the positioning cylinder, the pressure switch is operated for operating the safety valve to switch between the first, rest, closed condition into the second, working, pressure relief condition; and each of the safety valves being connected by the connecting means such that all of the safety valves are operated together to the second, working, relief position when one of the safety valves is operated to that position.

15. The roller press of claim 14, further comprising an electric relay electrically connected to be switched by the signal which switches any of the safety valves from the first to the second positions, and which is connected for holding all of the safety valves in the second positions, the relay including a switch for being reset for enabling the connected safety valves to be reset to the first positions thereof.

* * * * *